US005382879A

United States Patent [19]

Council et al.

[11] Patent Number: 5,382,879

[45] Date of Patent: Jan. 17, 1995

[54] RF FLUORESCENT LIGHTING SYSTEM

[75] Inventors: William J. Council, Newbury Park; Robert F. McClanahan, Valencia; Robert D. Washburn, Malibu, all of Calif.

[73] Assignee: Hughes Aircraft Company, Los Angeles, Calif.

[21] Appl. No.: 196,883

[22] Filed: Feb. 15, 1994

Related U.S. Application Data

[63] Continuation of Ser. No. 983,106, Nov. 30, 1992, abandoned, which is a continuation of Ser. No. 649,644, Feb. 1, 1991, abandoned.

[51] Int. Cl.[6] ..... H05B 41/16

[52] U.S. Cl. ..... 315/248; 315/39; 313/607; 313/234; 313/621

[58] Field of Search ..... 315/248, 344, 39, 267; 313/607, 234, 621

[56] References Cited

U.S. PATENT DOCUMENTS

| | | | |
|---|---|---|---|
| 2,800,622 | 7/1957 | Lion | 315/248 |
| 2,943,223 | 6/1960 | Fay | 313/234 |
| 4,792,732 | 12/1988 | O'Loughlin | 315/248 |
| 4,798,997 | 1/1989 | Egami | 315/248 |
| 5,013,966 | 5/1991 | Saikatsu | 313/234 |

*Primary Examiner*—Robert J. Pascal
*Assistant Examiner*—Michael B. Shingleton
*Attorney, Agent, or Firm*—L. A. Alkov; W. K. Denson-Low

[57] ABSTRACT

A fluorescent lighting system that includes a gas containment vessel having an internal phosphor coating and containing an ionizable gas, field concentrator electrodes supported inside or outside the gas containment vessel, and an RF power source coupled directly or capacitively to the field concentrator electrodes.

11 Claims, 2 Drawing Sheets

FIG. 4
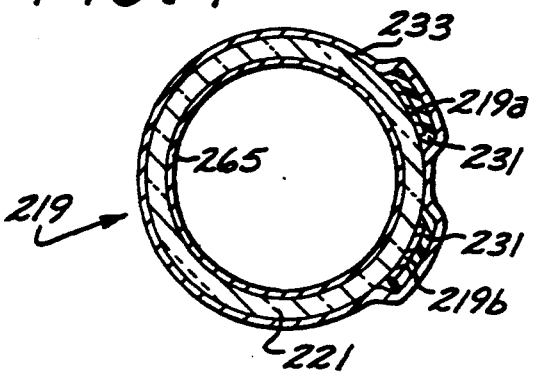
FIG. 7
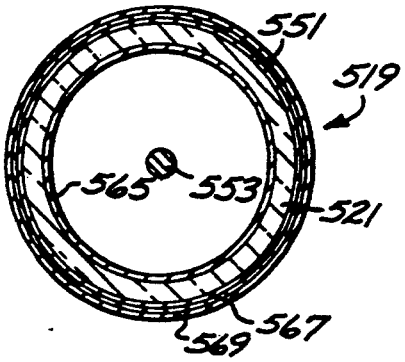
FIG. 6
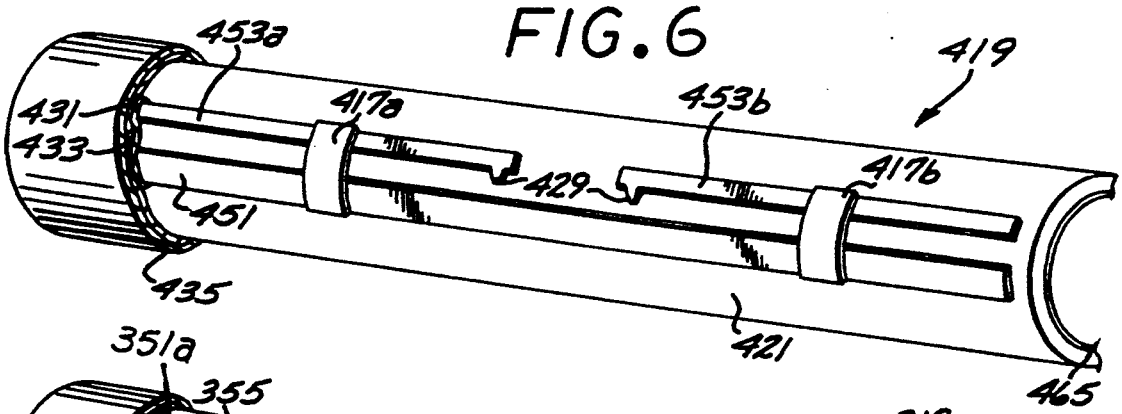
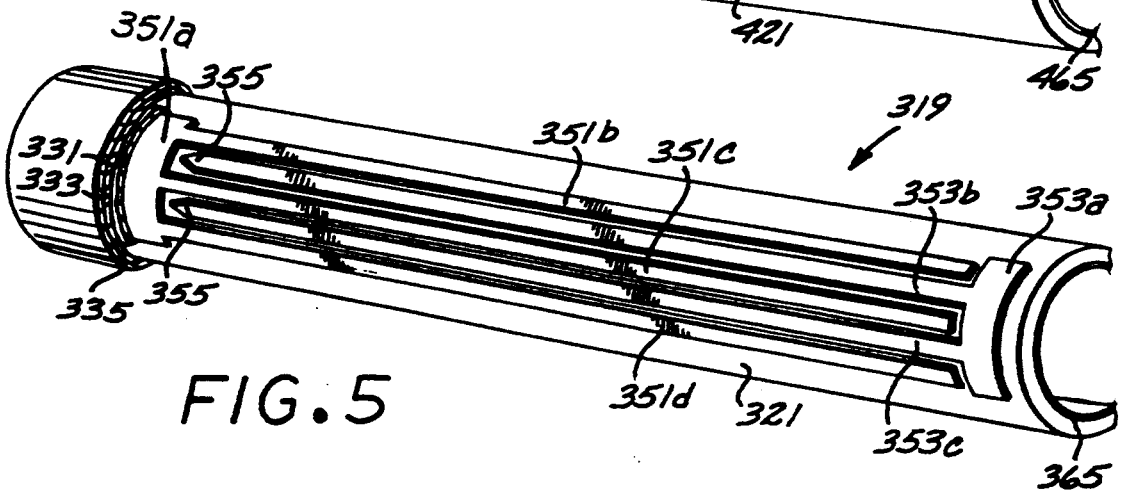
FIG. 5
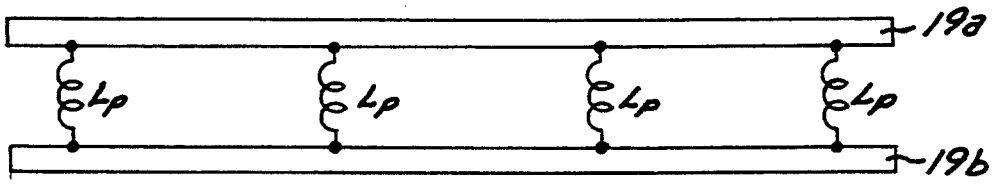
FIG. 8

RF FLUORESCENT LIGHTING SYSTEM

This is a continuation of application Ser. No. 07/983,106, filed Nov. 30, 1992, now abandoned, which is a continuation of application Ser. No. 07/649,644 filed Feb. 1, 1991.

BACKGROUND OF THE INVENTION

The subject invention is directed generally to fluorescent lighting systems, and is directed more particularly to a radio frequency (RF) fluorescent lighting system.

Fluorescent lighting systems are utilized for illumination in a wide variety of localized and general area lighting applications. These include residential, office, and factory lighting as well as work lights, back lights, display illumination and emergency lights.

Known fluorescent lighting systems typically comprise a fluorescent lamp, a starter and ballast power supply, and a fixture. Options include reflectors, diffusers, photosensors, and dimming controls. The ballasts for known fluorescent lighting systems can be generally classified as (a) coil and magnetic core, or (b) electronic.

Considerations with coil and magnetic core ballast systems include low efficiency for conversion of electrical input to light output, as well as large size and heavy weight. Such systems also typically have a poor power factor. Considerations with electronic ballast systems include low conversion efficiency, cost and large size. Considerations common to all present fluorescent lighting systems include limited fluorescent tube life due no electrode erosion and their vulnerability to gas seal degradation. Further, conventional fluorescent lighting systems, including so-called fast warm up designs, turn on relatively slowly and are limited and/or excluded from some applications.

SUMMARY OF THE INVENTION

It would therefore be an advantage to provide a fluorescent lighting system that is smaller and lighter than present systems.

Another advantage would be to provide a fluorescent lighting system that has higher power conversion efficiency than present systems.

A further advantage would be to provide a fluorescent lighting system that provides for longer bulb life.

Still another advantage would be to provide a fluorescent lighting system that has faster turn on speed than present systems.

The foregoing and other advantages are provided by the invention in a fluorescent lighting system that includes a gas containment tube having an internal phosphor coating and containing an ionizable gas, field concentrator electrodes supported inside or outside the fluorescent tube, and an RF power source coupled to the field concentrator electrodes.

BRIEF DESCRIPTION OF THE DRAWINGS

The advantages and features of the disclosed invention will readily be appreciated by persons skilled in the art from the following detailed description when read in conjunction with the drawing wherein:

FIG. 4 illustrates an example of an external electrode structure for the RF fluorescent lighting system of FIG. 1.

FIGS. 5-7 illustrate further examples of electrode structures for the RF fluorescent lighting system of FIG. 1.

FIG. 8 shows a schematic diagram of phase correction circuitry that can be utilized with electrode structures that include elongated elements.

DETAILED DESCRIPTION OF THE DISCLOSURE

Figure 1:
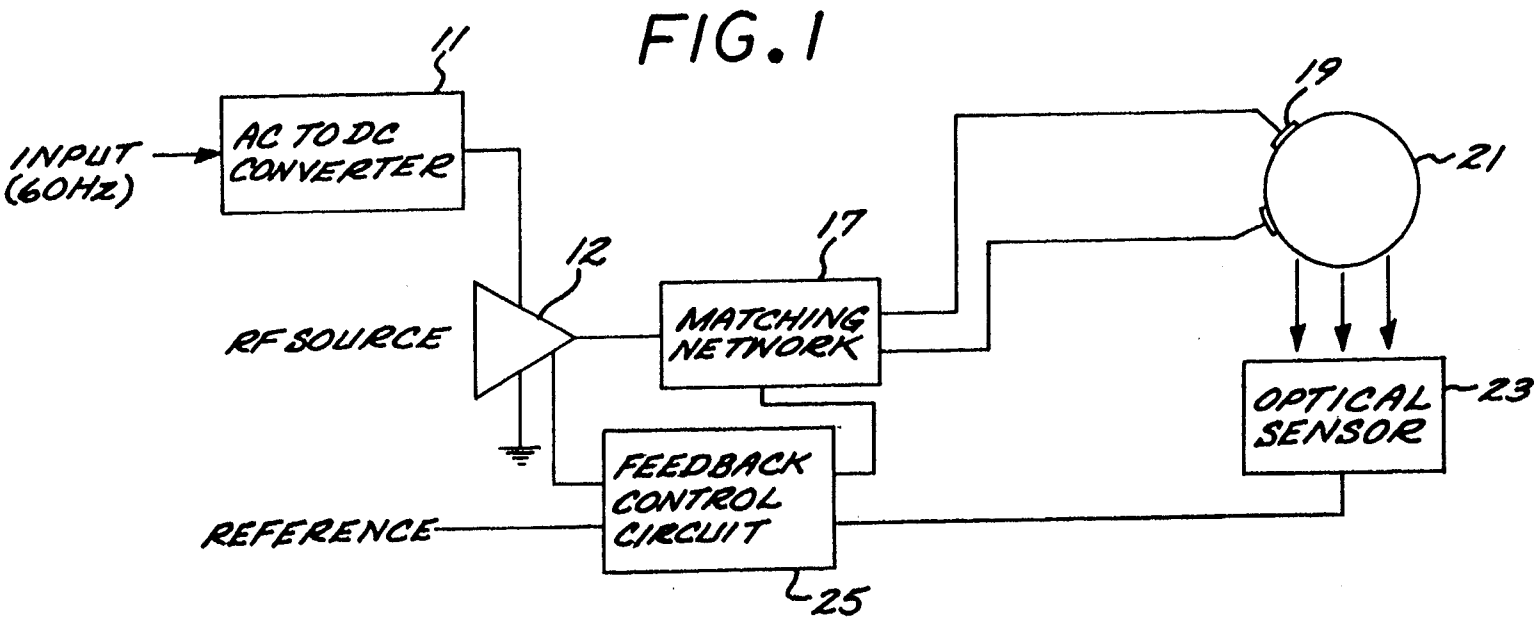
FIG. 1 is a block diagram of an RF fluorescent lighting system in accordance with the invention.

In the following detailed description and in the several figures of the drawing, like elements are identified with like reference numerals.

Referring now to FIG. 1, shown therein is a block diagram of an RF fluorescent lighting system that includes an AC to DC converter 11 that converts AC power such as electric utility 60 Hz power to DC power. For example, the AC to DC converter comprises a switching power supply that provides a regulated DC output voltage and achieves a very high power factor on the AC input.

The AC to DC converter 11 provides DC power for an RF power source 12 that is configured, for example, to reasonably appear as a voltage source, which is beneficial in applications where the load can vary over a large range, as in light dimming. The RF source 12 has an operating frequency that is in the range from VHF (which starts at about 30 MHz) into SHF (which begins at about 3 GHz), and can comprise known RF power source designs such as, for example, the RF oscillator, RF preamplifier, and RF power amplifiers disclosed in commonly assigned U.S. Pat. No. 4,980,810, Dec. 25, 1990, incorporated herein by reference. The RF source can be implemented in a variety of forms such as with individually packaged components on a printed circuit board or a power hybrid. A variety of tube RF circuits could also be utilized.

For operation from a DC source such as a battery, the converter 11 is omitted or may be replaced by a DC to DC converter.

The output of the RF source 12 is provided to a matching network 17 that transfers RF power to an electrode structure 19 secured to the inside or outside of a sealed gas containment glass tube 21 that contains an ionizable gas and includes an internal phosphor coating which emits visible light in response to ultraviolet radiation that is produced by ionization of the contained gas. The following description in the context of a glass tube is not intended to limiting in that the invention contemplates other forms of gas containing vessels such as bulbs.

A feedback control circuit 25 controls the output level of the RF source 12 and is responsive to a reference signal provided by a dimmer circuit (not shown), for example. Feedback inputs to the feedback control circuit 25 are provided by an optical sensor 23 that senses the light output and the output of the matching network 17. The optical sensor 23 comprises, for example, an optical detector such as a photodiode. Alternatively, a single feedback input can be provided by either the matching network 17 or the optical detector 23. In the latter case, it is assumed that the light output intensity will remain fairly constant for a given power input over long periods of time, which should be a reasonable assumption for most applications. It should be appreciated that in many applications the feedback control circuit and the optical sensor may not be necessary, in which case the light output will vary with the input power to the RF source. It should be appreciated that the AC to DC converter can be implemented to minimize this variation.

The matching network 17 is configured to provide efficient power transfer, the necessary voltage on the electrodes 19 to insure gas ionization, and a large open circuit voltage when the gas in the tube is not ionized. Due to the very low source impedance presented by the RF source 12, very large voltage step-ups are required for ignition, which is easily provided by the matching network 17, with the requirement that the loaded Q of the network be determined only by the ignited discharge. By way of example, the matching network 17 can be implemented with known RF matching networks including L-networks, pi-net-works, T-networks, and auto-transformer networks. The matching network 17 is preferably physically located in close proximity to the electrode structure 19, and comprise, for example, components printed on the inside or outside of the glass tube, or hybrid circuitry secured to the inside or outside of the tube, depending on the particular structure of the electrode structure.

Alternatively, the output of the RF source can be provided to a splitter network whose outputs are provided to a plurality of matching networks, each of which is connected to respective electrode structures. It should be appreciated that the power splitter could also be used to provide power to multiple fluorescent tube structures.

The fluorescent lighting system can be configured to have one of the electrodes grounded, which may be required for some applications, or the electrodes can be differentially operated. The differential configuration requires matching networks that provide symmetrical outputs phase shifted 180 degrees apart, and the differential RMS voltage across the electrodes can be the same as in the grounded electrode structure. The differential configuration has the added advantages of reduced far field radiation (EMI/RFI) and reduced voltage stress on the matching network components and on the electrodes, as compared to the grounded electrode configuration.

The electrode structure 19 is configured to accurately control the electric field produced by the RF energized electrodes so as to produce a uniform field, and more particularly are mechanisms for controlling the shape of the electric field and its intensity. Since the electrode structure functions as a field concentrator, it does not need to be in contact with the gas inside the tube 21 and can be external to the tube 21, which reduces manufacturing cost and increases reliability.

Basically, the electrode structure should provide optimum coupling of energy from the RF source to the gas medium of the lamp, and energy fields associated with RF should be contained closely to the region of the lamp gas.

The following are examples of electrode structures that provide relatively close coupling characteristics.

Figure 3:
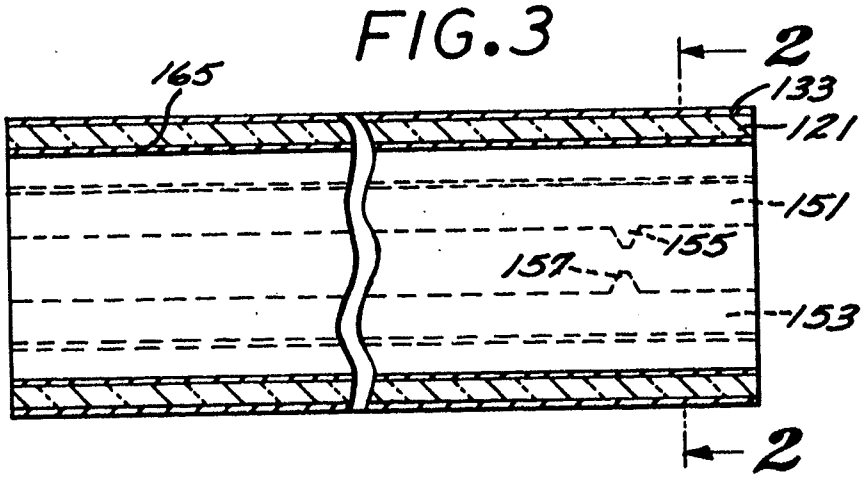
FIGS. 2 and 3 illustrate an example of an internal electrode structure for the RF fluorescent lighting system of FIG. 1.
Figure 2:
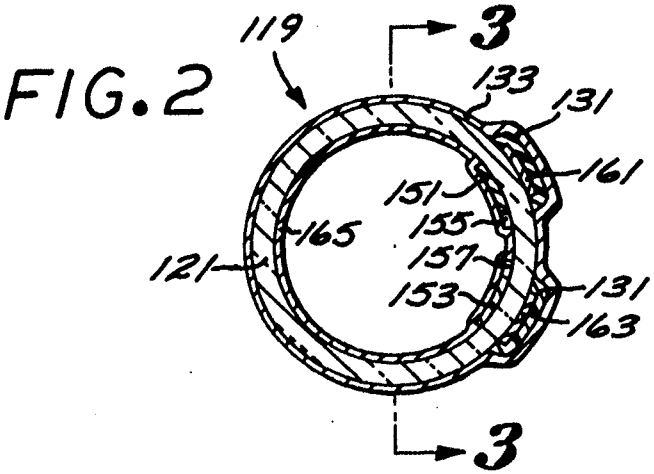

Referring now to FIGS. 2 and 3, schematically depicted therein by way of illustrative example is an electrode structure 119 comprising parallel elongated internal electrodes 151, 153 which extend in the longitudinal direction of a gas containment glass tube 121 and are capacitively coupled to the impedance matching network by external capacitive coupling pads 161, 163 disposed on the outside of the tube 121. The internal electrodes 151, 153 extend the length of the tube and include opposing ignition tabs 155, 157 for start-up. The internal electrodes 151, 153 comprise, for example, deposited metallization and have no physical electrical connections to circuitry outside the tube. A phosphor coating 165 is disposed on the inside surface of the tube 121 and on the internal electrodes 151, 153. Transparent insulation layers 131 are disposed over the external capacitive coupling pads 161, 163, and an optically transparent, electrically conductive shielding coating 133 envelopes the tube and the insulating layers.

Referring now to FIG. 4, shown therein by way of further example is an electrode structure 219 comprising parallel elongated external electrodes **219*a* , 219*b* which are disposed on the outside of a gas containment tube 221 which includes an internal phosphor coating 265 and contains an ionizable gas. The external electrodes extend along the longitudinal direction of the tube and are directly connected to the matching network 17. For start-up, the external electrodes 219*a*, 219*b* include opposing ignition tabs substantially similar to the ignition tabs 155, 157 of the internal electrodes shown in FIG. 3. Transparent insulation layers 231 are disposed over the external electrodes 219*a*, 219*b*, and an optically transparent, electrically conductive shielding coating 233 envelopes the tube and the insulating layers. The external electrodes 219*a*, 219*b* comprise deposited metallization, for example. An optically transparent insulating layer (not shown) may be disposed over the transparent conductive shielding coating 233**.

Referring now to FIG. 5, schematically shown therein by way of another example is an electrode structure 319 which can be implemented as internal electrodes or as external electrodes (as shown for ease of illustration) disposed on a gas containment glass tube 321 which includes an internal phosphor coating 365. The electrode structure 419 includes a return pad 351a at one end of the tube and a power pad **353*a* at the other end of the tube. Parallel elongated return electrodes 351*b*, 351*c*, 351*d* extending along the longitudinal direction of the fluorescent tube 321 and commonly connected to the return pad 351*a* are interleaved with parallel elongated power electrodes 353*b*, 353*c* extending along the longitudinal direction of the fluorescent tube 321 and commonly connected to the power pad 353*a*. The unconnected ends of the elongated power electrodes 353*b*, 353*c* include ignition tabs 355. An optically transparent insulating layer 331 is disposed over the electrode structure 319 and an optically transparent, electrically conductive shielding layer 333 envelopes the tube and the insulating layer. An optically transparent insulating layer 335 is disposed on the conductive shielding layer 333**.

For the internal electrode implementation of the electrode structure 319, capacitive coupling pads, similar to the capacitive coupling pads for the electrode structure of FIG. 2, would be provided for capacitively coupling the power and return conductive pads to the matching network 17 (FIG. 1), which as discussed above, should be in close physical proximity to the electrode structure.

FIG. 6 sets forth by way of further example an electrode structure 419 which can be implemented as internal electrodes or as external electrodes (as shown for ease of illustration) disposed on a gas containment glass tube 421 which includes an internal phosphor coating 465. The electrode structure 419 includes an elongated return electrode 451 which extends along the longitudinal direction of the fluorescent tube 421 and elongated segmented collinear power electrodes 453*a*, 453*b* which are parallel to the return electrode 451. The respective power electrodes are driven via respective matching networks, schematically shown as elements 417*a*. 417*b*. The inside ends of the power electrodes 453*a*, 453*b* include ignition tabs 455 oriented toward the return electrode 451. An optically transparent insulating layer 431 is disposed over the electrode structure 419 and an optically transparent, electrically conductive shielding layer 433 envelopes the tube and the insulating layer. An optically transparent insulating layer 435 is disposed on the conductive shielding layer 433.

For the internal electrode implementation of the electrode structure 419, capacitive coupling pads, similar to the capacitive coupling pads for the electrode structure of FIG. 2, would be provided for capacitively coupling the return and power electrodes to the respective matching networks which, as discussed above, should be in close physical proximity to the electrode structure.

Referring now to FIG. 7, shown therein by way of yet another example of an electrode structure 519 comprising a center power electrode 553 centrally located in a gas containment tube 521 having an internal phosphor coating 565. In particular, the center power electrode 553 is located on the longitudinal axis of the tube and extends between the ends of the tube. A return electrode 551 comprises an optically transparent electrically conductive coating on the outside of the tube. The center electrode 553 and the conductive coating electrode 551 are directly connected to the matching network 17. An optically transparent insulating layer 567 and an optically transparent electrically conductive shielding coating 569 can be disposed over the conductive coating electrode 551.

In the foregoing internal and external electrode implementations, the widths of the field concentrating electrodes and the spacing therebetween depends on factors including gas pressure, operating frequency of the RF source, gas composition, and tube geometry. As to the internal electrode structure, the capacitive coupling electrodes can comprise areas that do not extend the length of the internal electrodes. It should also be appreciated that the internal electrodes can be directly connected to the matching network 17 by appropriate conductive elements and gas seals in the tube.

As to the use of elongated electrode elements, when the length of the electrode is a significant portion of the wavelength at the frequency of operation, the RF voltage can vary greatly along the length of the electrode elements. In addition to being measurable, this variation can appear visibly in the form of luminosity wherein some areas of the lamp appear brighter than others. One solution to this problem is the use of segmented electrode elements as for example shown in FIG. 6. Another solution is to utilize phase correction pursuant to the teachings of commonly assigned U.S. Pat. No. 4,352,188, incorporated herein by reference. Referring to the schematic diagram of FIG. 8, such phase correction basically involves using shunt inductances Lp at predetermined intervals along the length of the power and return electrodes 19*a*, 19*b*. Such inductances comprise, for example, printed inductors connected between the power and return electrodes and appropriately disposed on the same gas containment tube surface that supports the electrode structure.

It should be appreciated that other forms of electrode structures can be utilized, depending upon factors such as the shape and size of the gas containment vessel, operating frequency of the RF source, and the required ratio of ignition voltage to sustaining voltage.

The foregoing has been a disclosure of a fluorescent lighting system that advantageously utilizes an RF circuit for producing the gas ionizing field, and is smaller and lighter than present systems, has higher power conversion efficiency than present systems, provides for longer bulb life, and has faster turn on speed than present systems.

Although the foregoing has been a description and illustration of specific embodiments of the invention, various modifications and changes thereto can be made by persons skilled in the art without departing from the scope and spirit of the invention as defined by the following claims.

What is claimed is:

1. A fluorescent light system comprising:

a gas containment tube having an internal phosphor coating and containing an ionizable gas;

RF drive means for producing a power RF signal;

first and second elongated electric field concentrating electrodes secured to said gas containment tube and responsive to said RF signal for producing an ionizing electric field within said gas containment tube, said elongated electrodes extending along the longitudinal direction of said gas containment tube and being parallel to each other so as to be adjacent each other along a portion of the longitudinal extent of said gas containment tube; and an ignition tab connected to said first elongated electric field concentrating electrode extending laterally therefrom toward said second elongated electric field concentrating electrode.

2. The fluorescent lighting system of claim 1 wherein said first electrode comprises segmented collinear electrodes, and wherein said second electrode comprises an elongated unitary electrode parallel to said segmented collinear electrodes.

3. The fluorescent lighting system of claim 1 including a further ignition tab connected to said second elongated electric field concentrating electrode extending laterally therefrom toward said first elongated electric field concentrating electrode.

4. A fluorescent light system comprising:

a gas containment tube having an internal phosphor coating and containing an ionizable gas;

RF drive means for producing a power RF signal;

a first group of commonly connected elongated electric field concentrating electrodes secured to said gas containment tube and extending along the longitudinal direction of said gas containment tube; and a second group of commonly connected elongated electric field concentrating electrodes secured to said gas containment tube and extending along the longitudinal direction of said gas containment tube;

said commonly connected elongated electrodes of said first group being interleaved with said commonly connected elongated electrodes of said second group, and said first and second groups of commonly connected electrodes being responsive to said RF power signal for producing an ionizing electric field within said gas containment tube.

5. The fluorescent lighting system of claim 4 wherein:

said commonly connected electrodes of said first group include (1) first ends connected to a first common pad and (2) second ends which are unconnected;

said commonly connected electrodes of said second group include (1) first ends connected to a second common pad and (2) second ends which are unconnected;

said second ends of said commonly connected electrodes of said first group include ignition tabs that extend toward said second common pad; and said second ends of said commonly connected electrodes of said second group include ignition tabs that extend toward said first common pad.

6. The fluorescent lighting system of claim 1 wherein said electric field concentrating means comprises internal electrodes disposed on the inside of said gas containment tube.

7. The fluorescent lighting system of claim 6 wherein said internal electrodes comprise an elongated electrode extending along the longitudinal direction of said gas containment tube and segmented collinear electrodes parallel to said elongated electrode.

8. The fluorescent lighting system of claim 6 wherein said internal electrodes are capacitively coupled to said RF drive means.

9. The fluorescent lighting system of claim 1 wherein said field concentrating means includes a conductive coating on the outside of said gas containment tube and an elongated electrode centrally located inside said gas containment tube along its longitudinal axis.

10. The fluorescent lighting system of claim 4 wherein said electric field concentrating means comprises internal electrodes disposed on the inside of said gas containment vessel.

11. The fluorescent lighting system of claim 10 wherein said internal electrodes are capacitively coupled to said RF drive means.

* * * * *